US006467127B1

(12) United States Patent
Goldstein

(10) Patent No.: US 6,467,127 B1
(45) Date of Patent: Oct. 22, 2002

(54) TELESCOPING CURTAIN RODS WITH CURTAIN HANGERS SLIDABLE ON ROLLERS

(75) Inventor: Allan Goldstein, Old Tappan, NJ (US)

(73) Assignee: Source Global Enterprises, Inc., Bronx, NY (US)

( * ) Notice: Subject to any disclaimer, the term of this patent is extended or adjusted under 35 U.S.C. 154(b) by 48 days.

(21) Appl. No.: 09/697,332

(22) Filed: Oct. 26, 2000

Related U.S. Application Data

(60) Provisional application No. 60/162,186, filed on Oct. 28, 1999.

(51) Int. Cl.[7] ..... A47H 15/00

(52) U.S. Cl. ..... 16/87 R; 16/95 R; 16/95 D

(58) Field of Search ..... 428/99; 16/87.4 R, 16/95 D, 88, 87 R, 89, 95 R; 211/105.3, 105.1

(56) References Cited

U.S. PATENT DOCUMENTS 4,166,306 A * 9/1979 Janson ..... 16/94 R

* cited by examiner

*Primary Examiner*—Alexander S. Thomas
(74) *Attorney, Agent, or Firm*—Levine & Mandelbaum

(57) ABSTRACT

A support rod for enabling a hung curtain to be smoothly drawn has two telescopically connected curtain rod segments and a trolley with at least one roller. In one set of embodiments, an outward facing channel is formed in the wall of the rod for receiving a roller while another rod engaging device can slidably contact the wall of the rod. In another embodiment, a trolley has a roller with wheels which ride on the in-turned edges of the rod which border a downward facing slot though which a curtain hanger projects. Snagging of the trolley is prevented by having the edges of the rod segments horizontally coplanar in one embodiment, and through the use of dual diameter wheels in another embodiment.

17 Claims, 14 Drawing Sheets

TELESCOPING CURTAIN RODS WITH CURTAIN HANGERS SLIDABLE ON ROLLERS

This application claims the benefit of provisional application 60/162,186 filed Oct. 28, 1999.

BACKGROUND OF THE INVENTION

This invention relates to traverse rods for curtains. More specifically, the invention is directed to traverse rods having curtain hangers slidable on rollers for reducing friction and binding of curtains when they are opened and closed.

Curtains are conventionally provided with hooks for suspension from tabs or rings slidably mounted on a curtain rod. In prior art curtain rods, friction between the tabs or rings on the one hand and the rod on the other hand interferes with smooth opening and closing of the curtains.

The use of rollers on a curtain rod is known in the prior art. U.S. Pat. No. 632,343 to Ebner for a Curtain Fixture discloses a rod having shoulders on which rollers mounted on the ends of a half-ring ride. A loop beneath the center of each half-ring can receive a curtain hook. U.S. Pat. No. 1,566,402 to Hees for a Curtain Pole teaches the construction of a C-shaped curtain rod having loops or hooks suspended from rollers which ride within the rod.

U.S. Pat. No. 2,890,799 to Rosenbaum for a Traverse Rod discloses a C-shaped curtain rod having loops or hooks suspended from rollers which ride on the in-turned edges of the rod.

However, prior are curtain rods which have hangers suspended on rollers are subject to snagging, especially when used with a telescoping rod wherein rollers must traverse a step at the interface of the telescoped rod sections.

SUMMARY OF THE INVENTION

The present invention overcomes the aforementioned problems of prior art traverse rods for curtains by enabling curtains to be opened and closed without binding. The invention provides for rings having one, two, three, four or possibly even more rollers which ride within longitudinal channels inside of and/or outside of a telescoping curtain rod, or which engage the inward turned longitudinal edges of a telescoping curtain rod. Embodiments of the invention provide for transition from one curtain rod section to another without a change in elevation of the roller-hanger assemblies for smooth, binding-resistant transport.

DESCRIPTION OF THE PREFERRED EMBODIMENT

Figure 1:
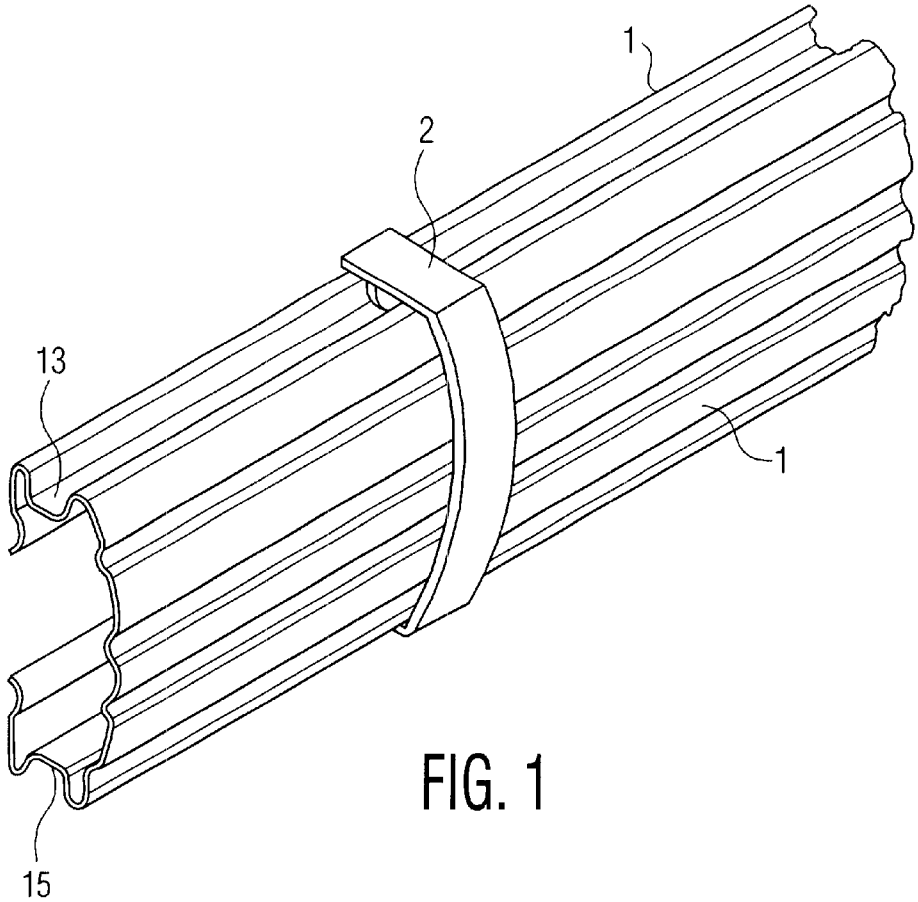
FIG. 1 is a fragmentary perspective view of a first preferred embodiment of the invention.

Referring now to the drawings, FIG. 1 shows one segment 1 of a telescoping curtain rod having a carrier or trolley 2. Each telescoping curtain rod segment 1 employed in a curtain rod is in the form of an open tube 1, with a C-shaped cross section, having outward facing channels 13 and 15 in its top and bottom exterior surfaces. The carrier 2 is slidably mounted for reciprocal movement along the outside of the rod segment 1. A curtain rod may be made up of two or more segments 1 connected in telescoping relationship as is known in the art.

Figure 3:
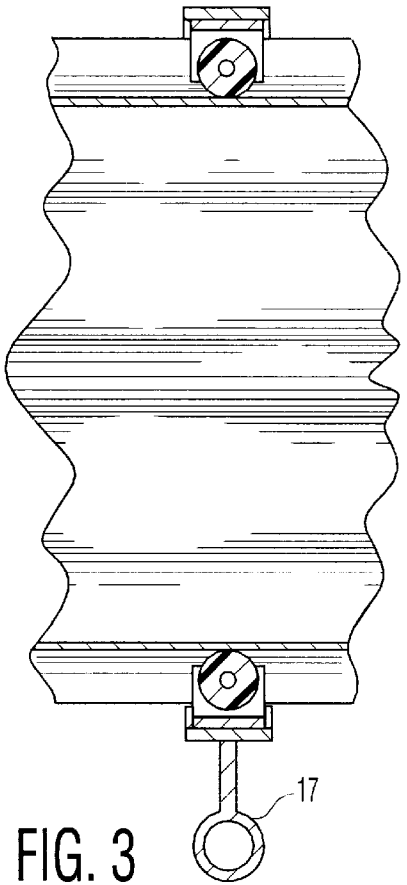
FIG. 3 is a fragmentary side sectional elevation view of the first preferred embodiment of the invention shown in FIG. 1.
Figure 2:
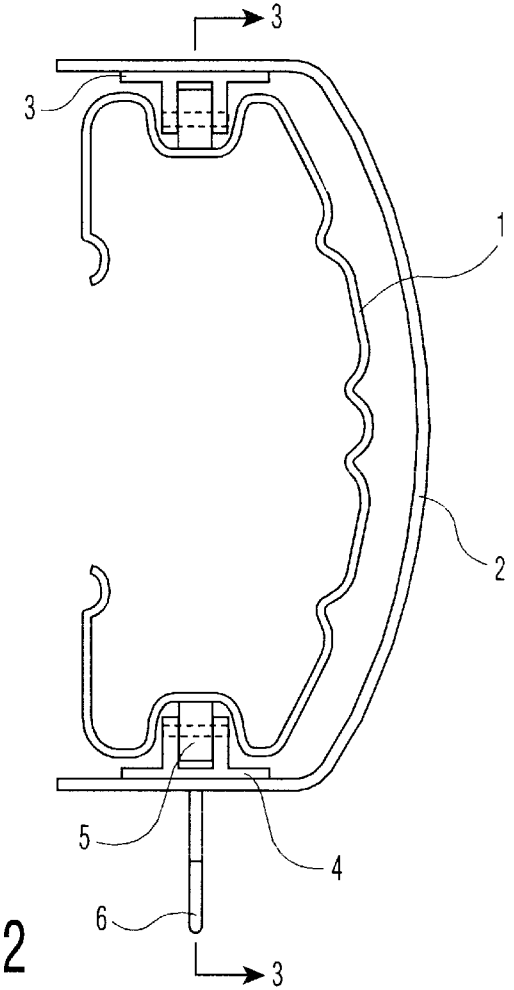
FIG. 2 is an end view of the first preferred embodiment of the invention shown in FIG. 1.

FIGS. 2 and 3 show the telescoping segment 1 with assembled carrier 2. Two wheel assemblies 3 are attached to carrier 2 and have their two wheels 5 respectively engaged in the top and bottom channels 13, 15 in the rod segment 1. Wheel supports 4 mounted on the carrier 2 hold each wheel 5. The wheels 5 enable a smooth traversing motion of the carrier 2 along the length of the rod, the carrier 2 being able to traverse from one segment to another.

A hanger 6 is provided for attaching draperies to the carrier 2. The hanger 6 may be include a tab with a loop for receiving a separate hook attached to the curtains as best seen in FIG. 3, or a hook (not shown) directly connectable to the curtains.

Figure 5:
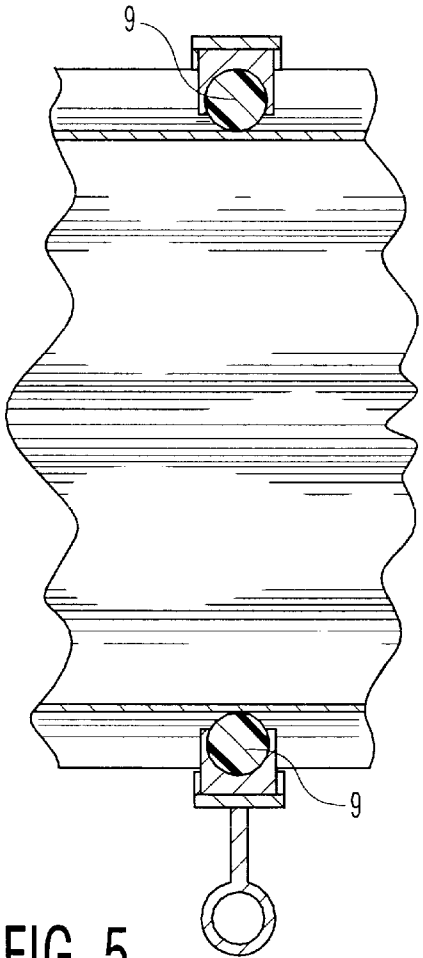
FIG. 5 is a fragmentary side sectional elevation view of the first preferred embodiment of the invention shown in FIG. 1 with the modification shown in FIG. 4.
Figure 4:
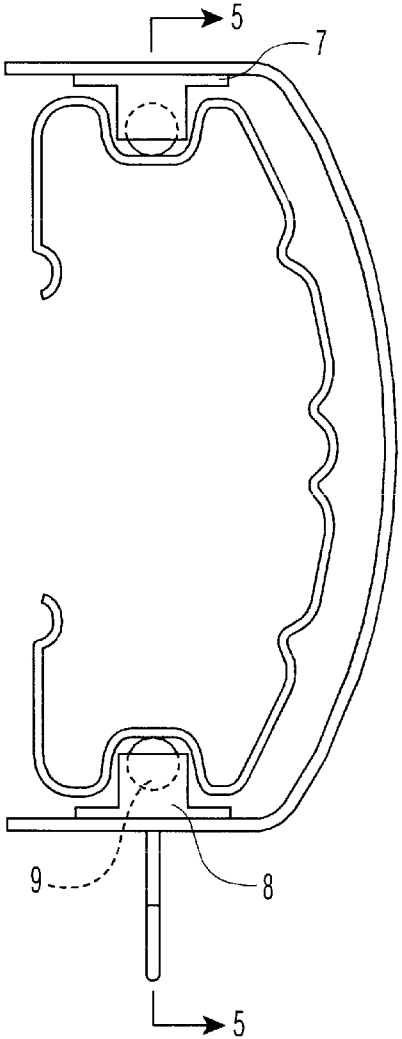
FIG. 4 is an end view of the first preferred embodiment of the invention shown in FIG. 1 with a modification.

FIGS. 4 and 5 show a modification of the curtain rod of FIGS. 1–3 in which ball bearing assemblies 7, instead of the wheel assemblies 3, are attached to the carrier 2 and engaged in channels in each segment 1. A ball socket 8 holds each ball 9 and attaches to carrier 2 to provide smooth traversing motion.

Figure 6:
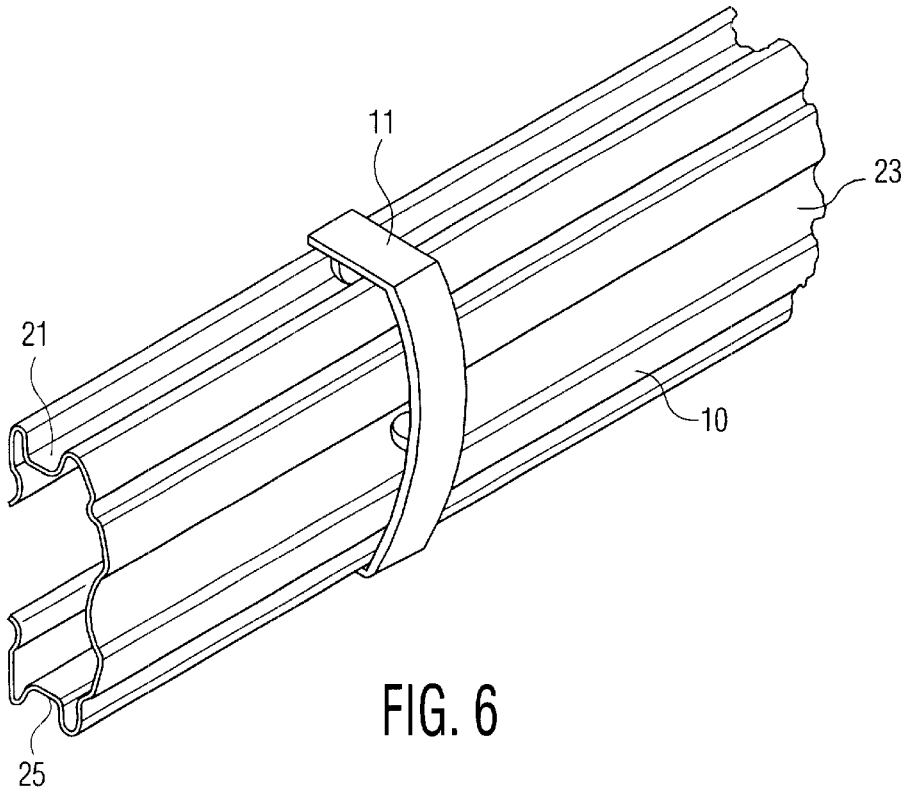
FIG. 6 is a fragmentary perspective view of a second preferred embodiment of the invention.
Figure 8:
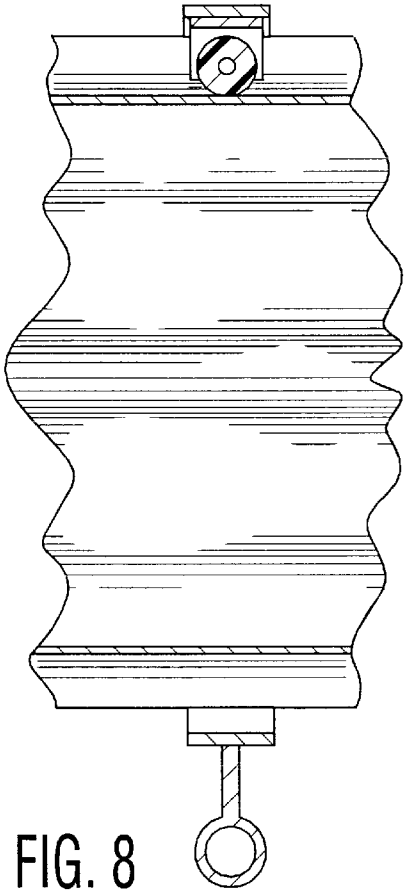
FIG. 8 is a fragmentary side sectional elevation view of the second preferred embodiment of the invention shown in FIG. 6.
Figure 7:
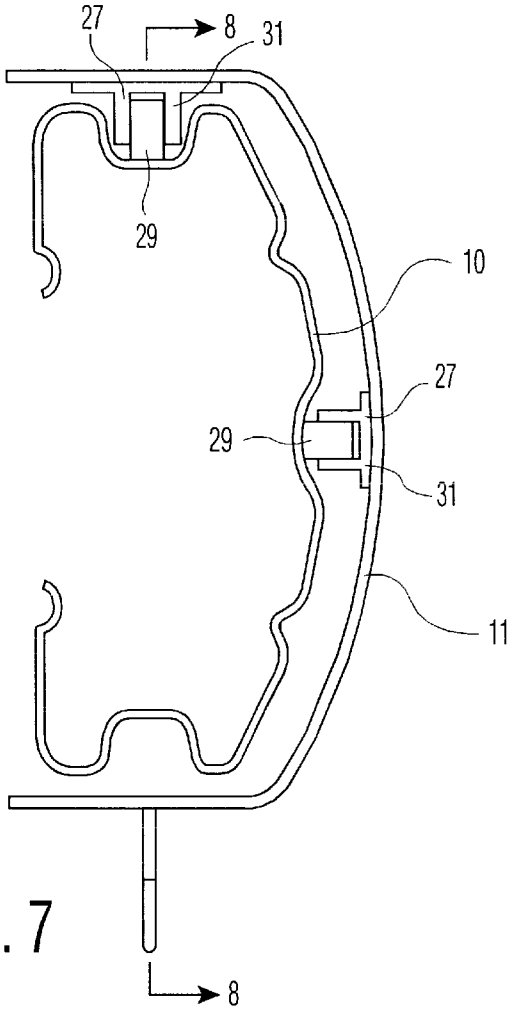
FIG. 7 is an end view of the second preferred embodiment of the invention shown in FIG. 6.

FIGS. 6–8 show a second embodiment of one segment 10 of a telescoping curtain rod with a carrier or trolley 11. The segment 10 has channels 21, 23, 25 in its outer top, front, and bottom surfaces. Two wheel assemblies 27 are attached to carrier 11 and have their two wheels 29 engaged in the top and front channels 21, 23, respectively, in the segment 10. Wheel supports 31 mounted on the carrier 11 hold each wheel.

Figure 10:
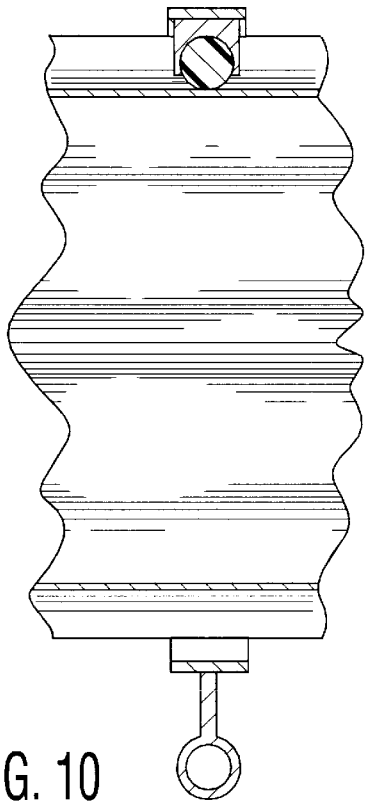
FIG. 10 is a fragmentary side sectional elevation view of the second preferred embodiment of the invention shown in FIG. 6 with the modification shown in FIG. 9.
Figure 9:
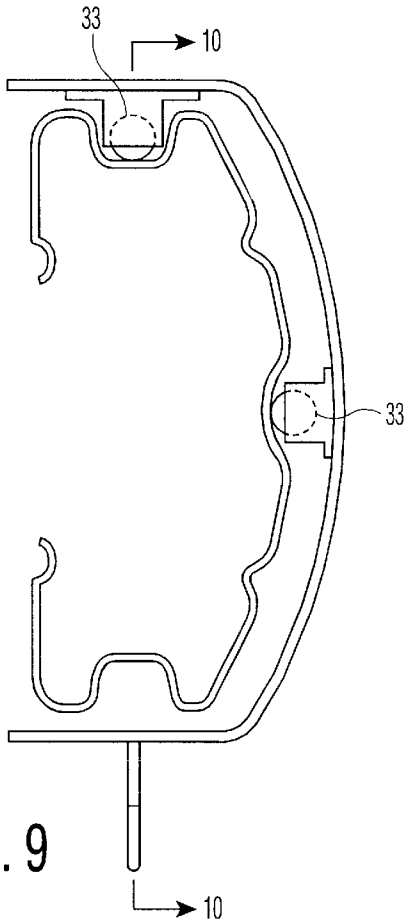
FIG. 9 is an end view of the second preferred embodiment of the invention shown in FIG. 6 with a modification.

FIGS. 9 and 10 show a modification of the second embodiment of FIGS. 6–8 wherein ball bearing assemblies 33 are substituted for the wheel assemblies.

Figure 12:
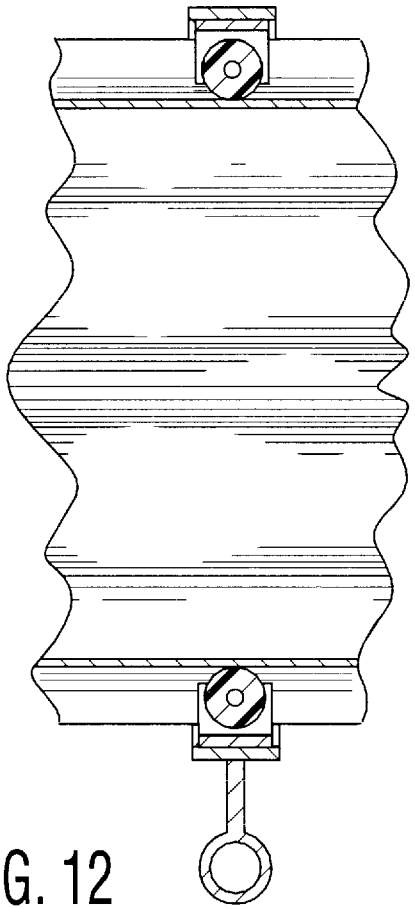
FIG. 12 is a fragmentary side sectional elevation view of the second preferred embodiment of the invention shown in FIG. 6 with the second modification shown in FIG. 11.
Figure 11:
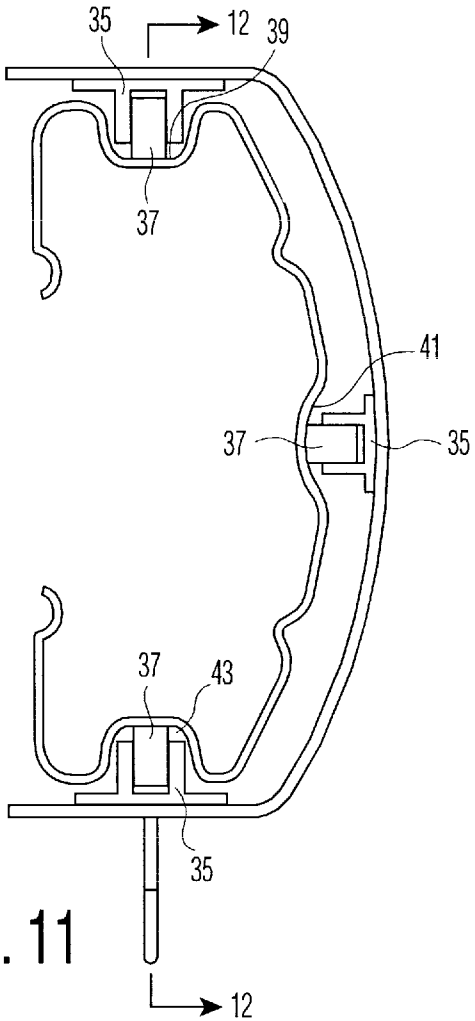
FIG. 11 is an end view of the second preferred embodiment of the invention shown in FIG. 6 with a second modification.

FIGS. 11 and 12 show a second modification of the second embodiment of FIGS. 6–8 wherein three wheel assemblies are provided for having their wheels 37 ride in channels 39, 41, 43 in the top, front and bottom of the open rod.

Figure 14:
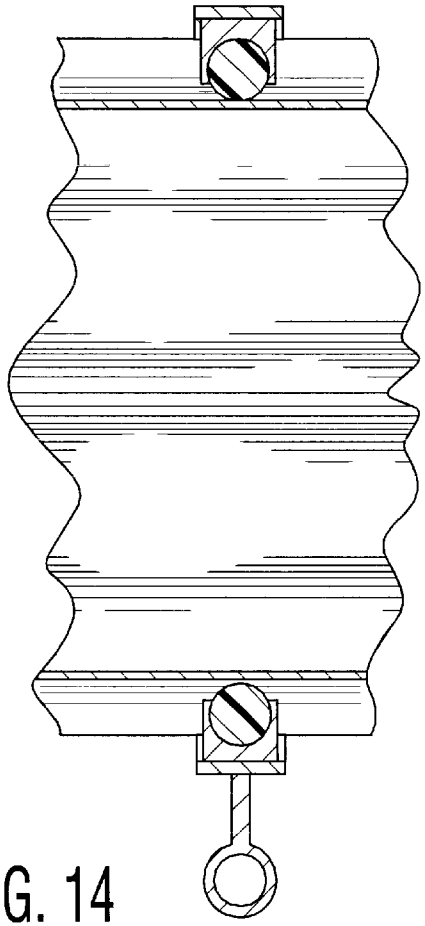
FIG. 14 is a fragmentary side sectional elevation view of the second preferred embodiment of the invention shown in FIG. 6 with the third modification shown in FIG. 11.
Figure 13:
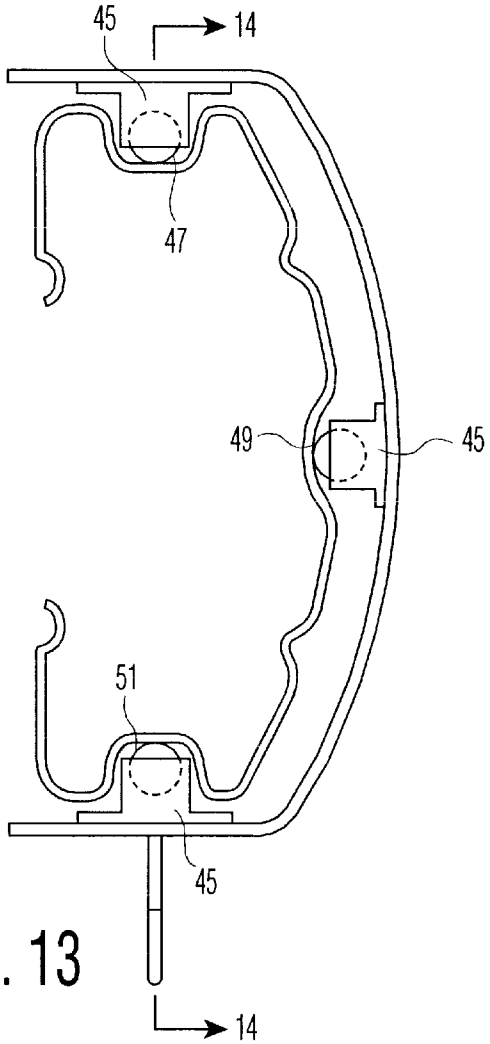
FIG. 13 is an end view of the second preferred embodiment of the invention shown in FIG. 6 with a third modification.

FIGS. 13 and 14 show a third modification of the second embodiment of FIGS. 6–8 wherein three ball bearing assemblies 45 are provided for having their ball bearings ride in channels 47, 49, 51 in the top, front and bottom of the open rod.

Figure 16:
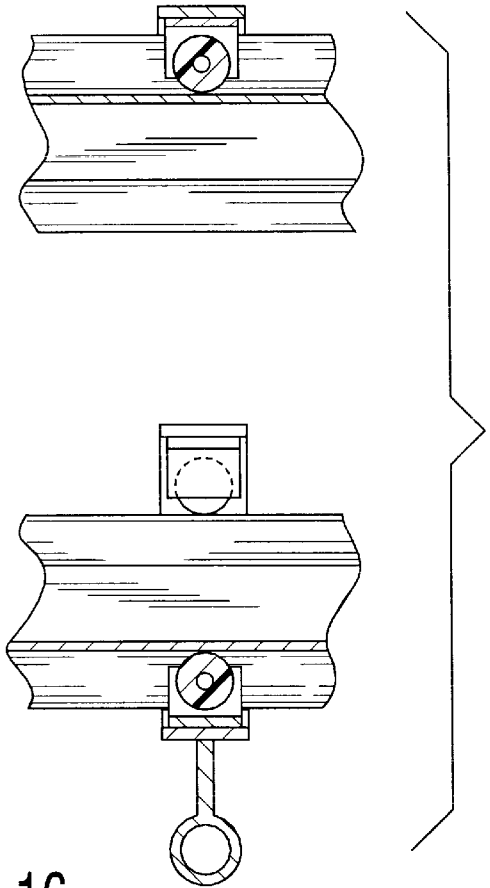
FIG. 16 is a fragmentary side sectional elevation view of the third preferred embodiment of the invention shown in FIG. 15.
Figure 15:
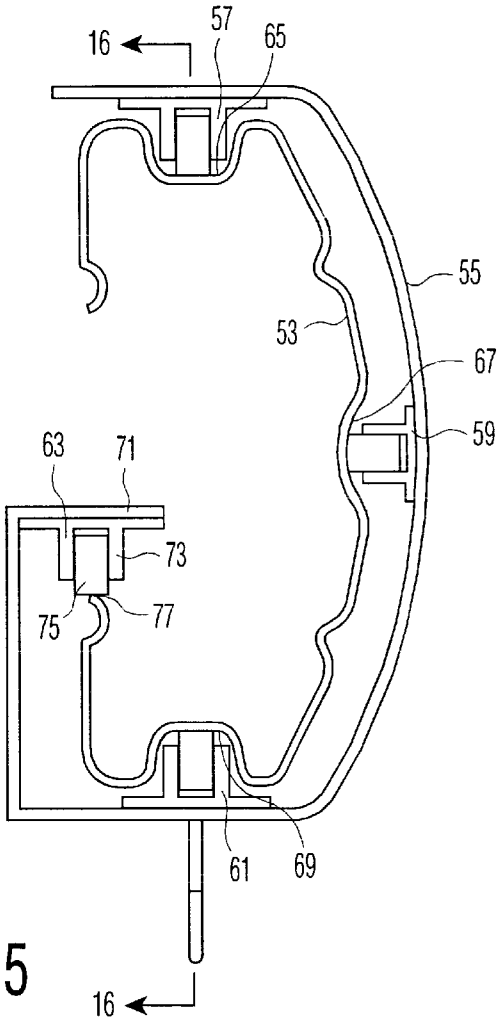
FIG. 15 is an end view of a third preferred embodiment of the invention.
Figure 18:
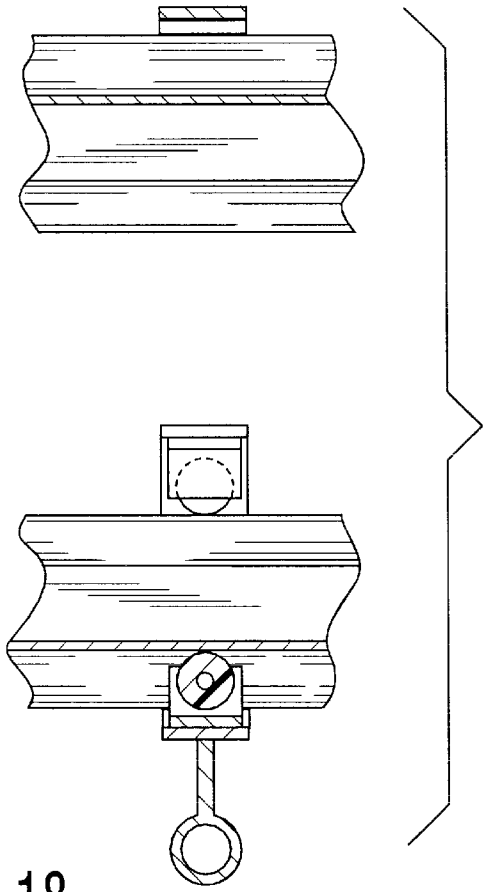
FIG. 18 is a fragmentary side sectional elevation view of the fourth preferred embodiment of the invention shown in FIG. 17.
Figure 17:
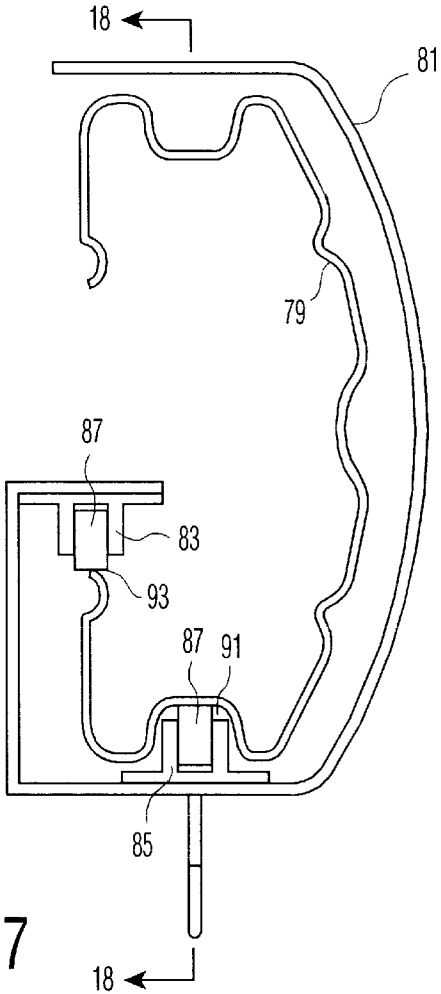
FIG. 17 is an end view of a fourth preferred embodiment of the invention.

FIGS. 15 and 16 show a third embodiment of the invention having a telescoping rod segment 53 and assembled carrier or trolley 55 on which there are mounted four wheel assemblies 57, 59, 61, 63. Three wheels 57, 59, 61 are engaged in the top, front, and bottom channels 65, 67, 69, respectively, and the bottom of an inwardly extending shelf 71 supports a fourth wheel assembly 73 having a wheel 75 which rides on the lower rear edge 77 of the curtain rod segment 53. FIGS. 17 and 18 show a fourth embodiment of the invention having a telescoping curtain rod segment 79 with assembled carrier or trolley 81 similar to that shown in FIGS. 15 and 16 but only with two wheel assemblies 83, 85 having wheels 87, 89 which respectively ride in the bottom channel 91 and on the lower rear edge 93 of the slotted curtain rod segment 79.

Figure 20:
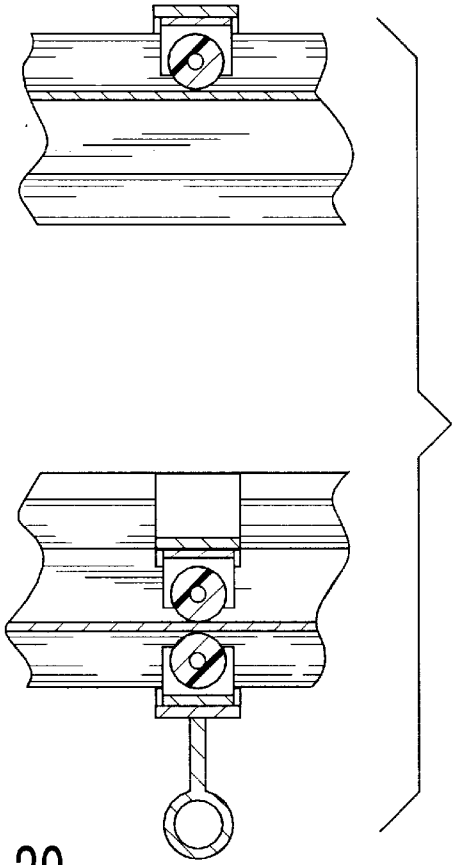
FIG. 20 is a fragmentary side sectional elevation view of the fourth preferred embodiment of the invention shown in FIG. 17 with the modification shown in FIG. 19.
Figure 19:
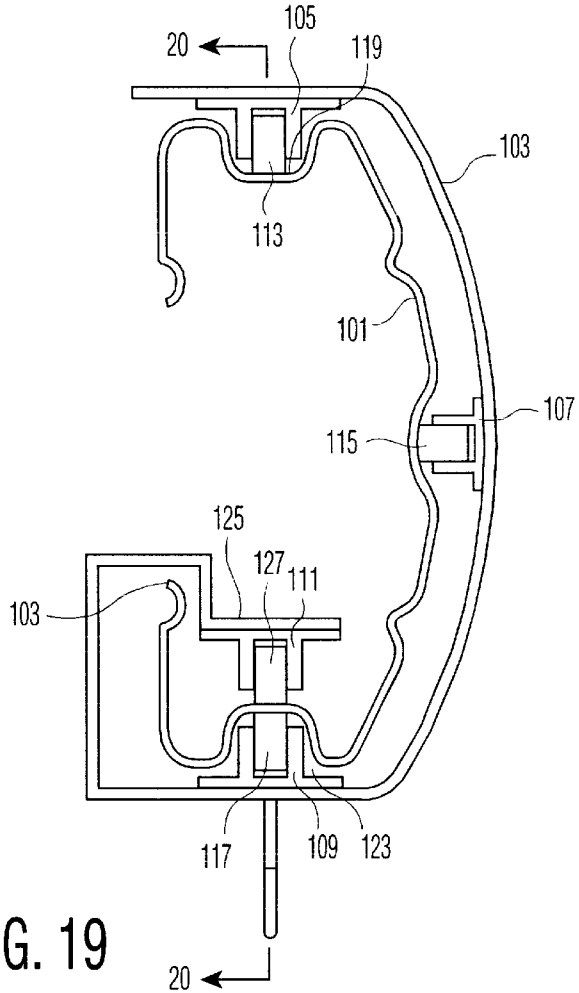
FIG. 19 is an end view of the fourth preferred embodiment of the invention shown in FIG. 17 with a modification.

FIGS. 19 and 20 illustrate a fourth preferred embodiment of the invention. A telescoping curtain rod segment 101 with assembled carrier or trolley 103 has four wheel assemblies 105, 107, 109, 111. Three wheels 113, 115, 117 are engaged in top, front, and bottom outer facing channels 119, 121, 123, respectively in the wall of the rod segment 101. The trolley extends inwardly and downwardly over the bottom edge 103 of the rod segment 101 and has an inwardly projecting step 125 under which there is suspended the fourth wheel assembly 111 having a wheel 127 which rides on the crest of the wall portion 129 of the rod segment 101 in which the outer bottom channel 123 is formed, just above the wheel in the bottom channel. The wall portion 129 of the rod segment 101 is, thus, sandwiched between the wheels 117 and 127.

Figure 21:
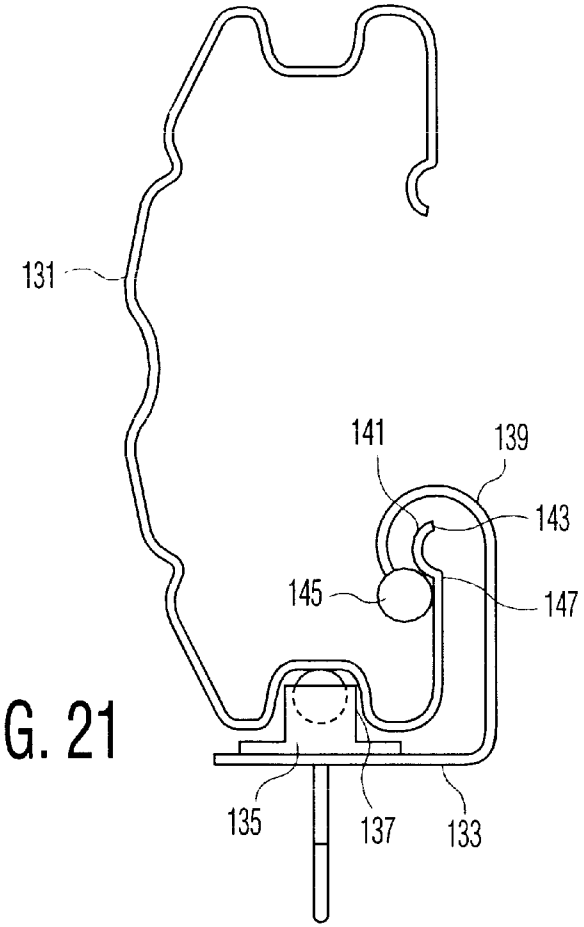
FIG. 21 is an end view of a fifth preferred embodiment of the invention.

FIG. 21 shows a fifth embodiment of a telescoping curtain rod segment 131 with assembled carrier or trolley 133 having one ball bearing assembly 135 that rides in the outward facing bottom channel 137 on the exterior of the rod segment 131. The trolley has a curved arm 139 which overlies a lip 141 along the bottom open edge 143 of the inward turned segment wall. Affixed to the free end of the arm 139 is a fixed smooth surfaced ball 145 which rides in an interior channel below the lip 141. The ball 145 is preferably made of a hard material, e.g., plastic or steel to minimize friction with the wall of the rod segment 131.

Figure 22:
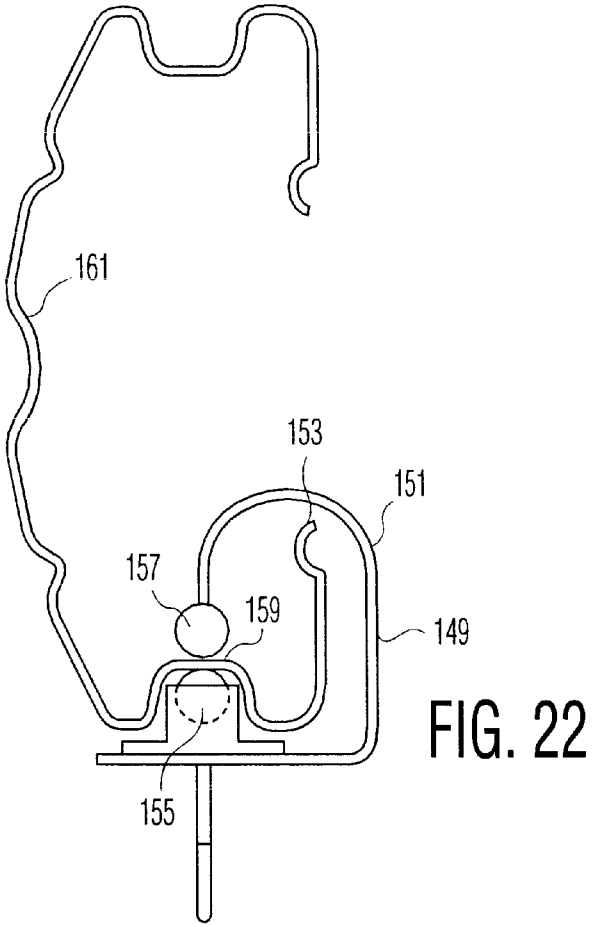
FIG. 22 is an end view of a sixth preferred embodiment of the invention.

FIG. 22 shows a sixth preferred embodiment of the invention having a carrier or trolley 149 similar to the carrier 133 shown in FIG. 21 with the following differences. The trolley 149 has a U-shaped arm 151 which extends downwardly into the rod segment cavity passed the bottom edge 153 of the inward turned segment wall to just above the ball bearing 155. Affixed to the free end of the arm is a fixed, hard, smooth surfaced ball 157. The wall portion 159 of the rod segment 161 is sandwiched between the ball bearing 155 and ball 157.

The carrier arm 151 is flexible and resilient and may be deformed as it is mounted on the rod segment 161 to force the ball bearing 155 and fixed ball 157 to assume their positions as shown in FIG. 22.

Figure 24:
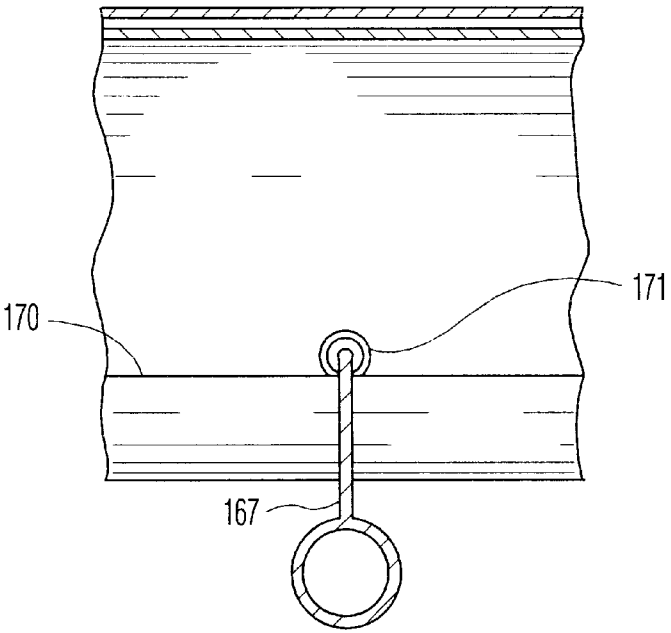
FIG. 24 is a fragmented side sectional side view of the seventh preferred embodiment of the invention shown in FIG. 23.
Figure 23:
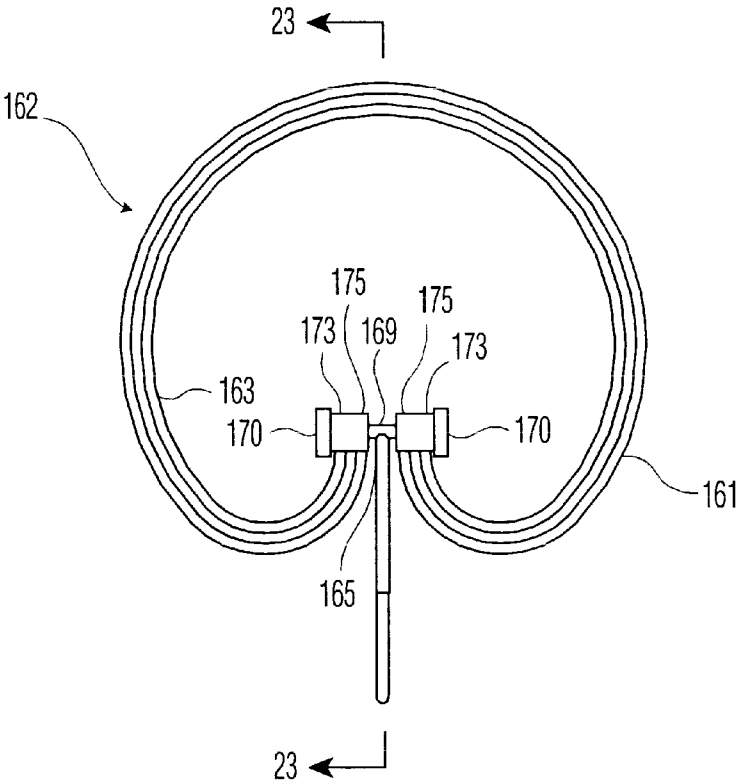
FIG. 23 is an end view of a seventh preferred embodiment of the invention.

FIGS. 23 and 24 show a seventh preferred embodiment of the invention which utilizes a curtain rod 162 having 10 telescoped segments 161, 163, each with an inwardly turned C-like cross section. The rod 162 is adapted to be mounted with a longitudinal slot 165 facing downwardly. The rod 162 is intended to be mounted on a conventional bracket (not shown) which circumscribes the top of the rod's circumference and a portion of one side of the rod, but not extending over the slot 165, thereby enabling a hanger 167 partially disposed within the slot 165 to be translated along the full length of the rod 162.

The hanger 167 is fixedly mounted on a trolley or carrier in the form of a cylindrical roller assembly 171 having an axle 169 joining two cylindrical wheels 173, each with a stepped diameter, that is having an inner step 175 with a relatively small diameter for riding on an adjacent set of longitudinal edges 170 of the respective rod segments 161, 163 and an optional outer step 177 of maximum diameter which extends vertically below the edges of the rod segments and laterally just beyond the edge of the outermost segment for supplementing the action of the hanger 167, which is trapped within the slot 165, in limiting sideways drift of the roller assembly 171 as it traverses the length of the rod 162. It is to be appreciated that the roller assembly 171 may be of unitary construction with the axle 169 fixed to the wheels 173 in which case the hanger 171 would be rotatably mounted with respect to the axle 169, e.g., by terminating the upper end of the hanger 167 in a loop circumscribing the axle. Alternatively, the wheels 173 may be rotatably mounted on the axle 169 in which case the hanger 167 can be fixed to the axle 169 as shown in the drawings.

The rod segments 161, 163 are dimensioned so that the inner segment 163 can be snugly but slidably received in the outer segment 161 thereby permitting relative movement between the segments 161, 163 in the axial, i.e., longitudinal, direction but preventing substantial movement between the rod segments 161, 163 in the vertical and lateral directions.

The cross section of the inner rod segment 163 is generally proportional to the cross section of the outer rod segment 161 except insofar as the inturned edges of the inner rod segment 163 extend a distance so that they are level with the inturned edges of the outer rod segment 161 when the inner rod segment 163 and outer rod segment 161 are telescopically connected. The level edges 170 of the rod segments 161, 163 enable the roller assembly 171 to traverse the junction where one of the rod segments ends and the roller assembly 171 is thereafter supported only on the edges of the other rod segment, with no change in elevation or "jump" which could interfere with the travel of the roller assembly at the junction and cause snagging as the curtain supported by the hanger 167 was drawn.

Figure 26:
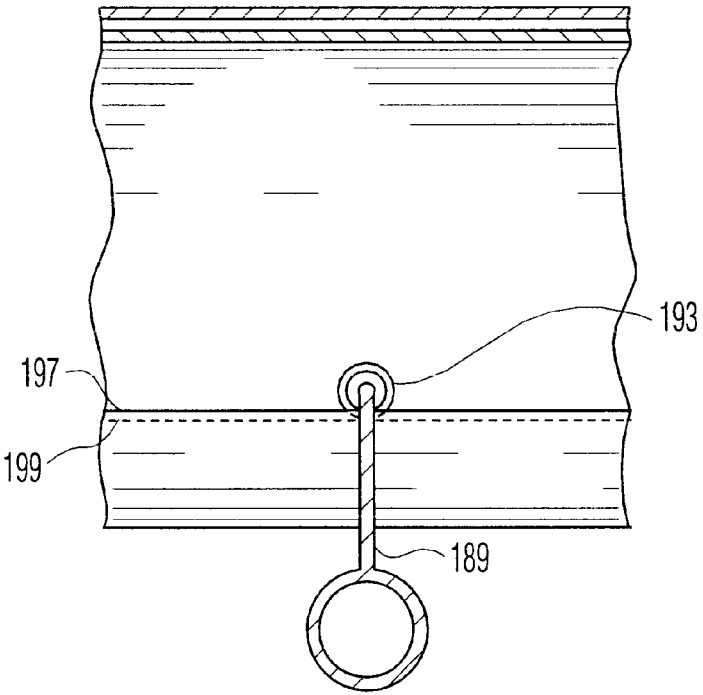
FIG. 26 is a fragmented side sectional side view of the eighth preferred embodiment of the invention shown in FIG. 25.
Figure 25:
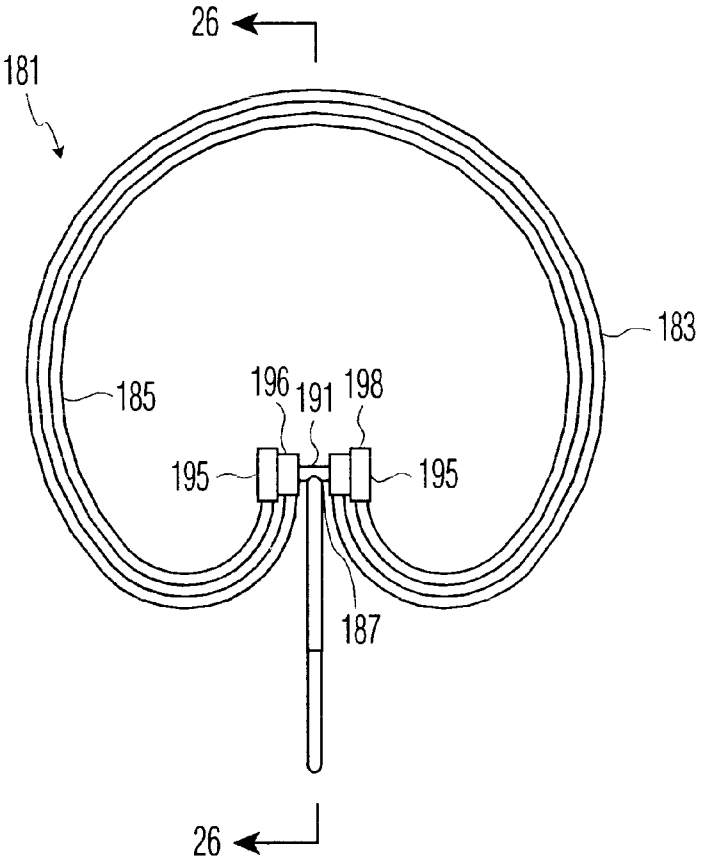
FIG. 25 is an end view of an eighth preferred embodiment of the invention.

FIGS. 25 and 26 show an eighth preferred embodiment of the invention in which a curtain rod 181 has telescoped segments 183, 185 with an inwardly turned C-like cross section. The rod 181 is adapted to be mounted with a longitudinal slot 187, opening into a hollow cavity within the rod 181, facing downwardly as described with respect to FIGS. 23 and 24. The cross section of the inner rod segment is generally symmetrical to the cross section of the outer rod segment. The rod 181 is also intended to be mounted on a conventional bracket which circumscribes the top of the rod's circumference and a portion of one side of the rod, but not extending over the slot, thereby enabling a hanger 189 partially disposed within the slot to be translated along the full length of the rod.

The hanger 189 is fixedly mounted an axle 191 of a cylindrical roller assembly 193 having two cylindrical wheels 195, each with a stepped diameter, that is having an inner step 196 with a relatively small diameter for riding on a longitudinal edge 197 of the outer rod segment and an outer step 198 of maximum diameter for riding on a longitudinal edge 199 of the inner rod segment 185. As in the embodiment of FIGS. 23 and 24, in the embodiment of FIGS. 25 and 26, the roller assembly may be of unitary construction or with rotatably mounted wheels 195.

The rod segments 183, 185 are dimensioned so that the inner segment 185 can be snugly but slidably. received in the outer segment 183 thereby permitting relative movement between the segments in. the axial, i.e., longitudinal, direction but preventing substantial movement between the rod segments in the vertical and lateral directions.

The difference between the respective diameters of the steps 196, 198 of each wheel is substantially equal to twice the difference in elevation between the edges 197, 199 of the outer and inner rod segments 183, 185, thereby enabling the roller assembly 193 to traverse the junction where one of the rod segments ends and the roller is thereafter supported only on the edges of the other rod segment, with no change in elevation or "jump" of the axle which could interfere with the travel of the roller assembly at the junction and cause snagging as the curtain supported by the hanger is drawn.

It is to be appreciated that the foregoing is a description of several preferred embodiments of the invention to which variations and modifications may be made without departing from the spirit and scope of the invention.

What is claimed is:

1. A support assembly for enabling a hung curtain to be smoothly drawn comprising a hollow rod having an outer wall surrounding an interior cavity within said rod, a portion of said wall having a longitudinal depression forming a first outwardly facing channel, said wall portion having an inner surface facing into said cavity and an outer surface facing into said channel, a trolley having first rod engaging means comprising a first roller disposed in said first channel for enabling relative translation of said trolley with respect to said rod, and second rod engaging means for preventing separation of said trolley from said rod.

2. A support assembly according to claim 1 wherein said wall further comprises a second outwardly facing channel and said second rod engaging means comprises a second roller disposed in said second channel.

3. A support assembly according to claim 2 wherein said first channel faces in a direction 180 degrees from the direction in which said second channel faces.

4. A support assembly according to claim 2 wherein said first channel faces in a direction 90 degrees from the direction in which said second channel faces.

5. A support assembly according to claim 1 wherein said wall further comprises a third outwardly facing channel and said trolley further comprises third rod engaging means disposed in said third channel.

6. A support assembly according to claim 5 wherein said first channel faces in a direction 180 degrees from the direction in which said second channel faces and said third channel faces in a direction 90 degrees from the direction in which said first channel faces.

7. A support assembly according to claim 1 wherein said wall has a longitudinal slot bounded by first and second parallel edges of said wall and said second rod engaging means comprises a second roller in engagement with one of said edges for riding therealong.

8. A support assembly according to claim 1 wherein said wall is sandwiched between said first and second rod engaging means.

9. A support assembly according to claim 1 wherein said second rod engaging means, is disposed within said cavity and is in engagement with an inward facing surface of said wall for riding therealong.

10. A support assembly for enabling a hung curtain to be smoothly drawn comprising a first hollow rod segment having an outer wall with a longitudinal slot opening into an interior cavity therewithin, a second hollow rod segment having an outer wall with a longitudinal slot opening into an interior cavity therewithin, a length of said second rod being received within the interior cavity of said first hollow rod whereby the slots of said first and second rod segments are coextensive, said longitudinal slot of said first rod segment being bounded by first and second parallel edges of the wall of said first rod segment, said longitudinal slot of said second rod segment being bounded by first and second parallel edges of the wall of said second rod segment, said first edges of said first and second rod segments being disposed on one side of said slot, said second edges of said first and second rod segments being disposed on a second side of said slot opposite to said first side, a trolley means comprising a roller having a central axle and first and second wheels respectively connected to opposite ends of said axle, a hanger having a first end connected to said axle and a second end adapted to support said curtain, said wheels engaging the first and second edges of at least one of said first and second rod segments.

11. A support assembly according to claim 10 further wherein said first edge of said first rod segment and said first edge of said second rod segment are in a common horizontal plane, and said second edge of said first rod segment and said second edge of said second rod segment are in a common horizontal plane, when said coextensive slots are facing downwardly, a diameter of said first wheel intersecting said first edge of said first rod segment is equal to a diameter of said first wheel in a plane intersecting said first edge of said second rod segment, and a diameter of said second wheel intersecting said second edge of said first rod segment is equal to a diameter of said second wheel in a plane intersecting said second edge of said second rod segment, whereby said trolley can snaglessly traverse from said first rod segment to said second rod segment without change in elevation.

12. A support assembly according to claim 10 further wherein said first edge of said first rod segment and said first edge of said second rod segment are in different horizontal planes having a first distance therebetween, and said second edge of said first rod segment and said second edge of said second rod segment are in different horizontal planes having a second distance therebetween, when said coextensive slots are facing downwardly, said first wheel having a first diameter intersecting said first edge of said first rod segment, said first wheel having a second diameter intersecting said first edge of said second rod segment, the difference in diameter between said first and second diameters of said first wheel being equal to twice said first distance, and said second wheel having a first diameter intersecting said second edge of said first rod segment, said second wheel having a second diameter intersecting said second edge of said second rod segment, the difference in diameter between said first and second diameters of said second wheel being equal to twice said second distance, whereby said trolley can snaglessly traverse from said first rod segment to said second rod segment without change in elevation.

13. A support assembly for enabling a hung curtain to be smoothly drawn comprising a hollow rod having an outer wall with a longitudinal slot opening into an interior cavity within said rod, said wall having a profile with a first outwardly facing channel and a second outwardly facing channel, a trolley having first rod engaging means comprising a first roller disposed in said first channel for enabling relative translation of said trolley with respect to said rod, and second rod engaging means comprising a second roller disposed in said second channel, said second rod engaging means preventing separation of said trolley from said rod, and said first channel facing in a direction 90 degrees from the direction in which said second channel faces.

14. A support assembly for enabling a hung curtain to be smoothly drawn comprising a hollow rod having an outer wall with a longitudinal slot opening into an interior cavity within said rod, said wall having a profile with a first outwardly facing channel, and a third outwardly facing channel, and a trolley having first rod engaging means comprising a first roller. disposed in said first channel for enabling relative translation of said trolley with respect to said rod, second rod engaging means for preventing separation of said trolley from said rod, and third rod engaging means disposed in said third channel.

15. A support assembly according to claim 14 wherein said third channel faces in a direction 90 degrees from the direction in which said first channel faces.

16. A support assembly for enabling a hung curtain to be smoothly drawn comprising a hollow rod having an outer wall with a longitudinal slot opening into an interior cavity within said rod, said wall having a longitudinal slot bounded by first and second parallel edges of said wall and a profile with a first outwardly facing channel, a trolley having first rod engaging means comprising a first roller disposed in said first channel for enabling relative translation of said trolley with respect to said rod, and second rod engaging means comprising a second roller in engagement with one of said edges for riding therealong, said second rod engaging means preventing separation of said trolley from said rod.

17. A support assembly for enabling a hung curtain to be smoothly drawn comprising a hollow rod having an outer wall with a longitudinal slot opening into an interior cavity within said rod, said wall having a profile with a first outwardly facing channel, a trolley having first rod engaging means comprising a first roller disposed in said first channel for enabling relative translation of said trolley with respect to said rod, and second rod engaging means for preventing separation of said trolley from said rod, said second rod engaging means being disposed within said cavity and in engagement with an inward facing surface of said wall for riding therealong.

* * * * *